United States Patent [19]

Lewis et al.

[11] 4,028,215

[45] June 7, 1977

[54] MANGANESE DIOXIDE ELECTRODE

[75] Inventors: David L. Lewis, Mentor; C. Richard Franks, North Madison; Barry A. Schenker, Mayfield Heights, all of Ohio

[73] Assignee: Diamond Shamrock Corporation, Cleveland, Ohio

[22] Filed: Dec. 29, 1975

[21] Appl. No.: 644,639

[52] U.S. Cl. ..... 204/290 F; 427/126

[51] Int. Cl.[2] ..... C25B 11/10; C25B 11/04

[58] Field of Search ..... 204/290 F (U.S. only); 427/126

[56] References Cited

UNITED STATES PATENTS

| | | | |
|---|---|---|---|
| 2,631,115 | 3/1953 | Fox | 136/138 |
| 3,616,302 | 10/1972 | Osawa et al. | 204/40 |
| 3,627,669 | 12/1971 | Entwisle et al. | 204/290 F |
| 3,850,764 | 11/1974 | Herczog et al. | 204/38 A |
| 3,855,084 | 12/1974 | Feige | 204/38 R |
| 3,882,002 | 5/1975 | Cook | 204/98 |
| 3,917,518 | 11/1975 | Franks et al. | 204/95 |
| 3,926,773 | 12/1975 | Koziol | 204/290 F |

*Primary Examiner*—F.C. Edmundson
*Attorney, Agent, or Firm*—Bruce M. Winchell

[57] ABSTRACT

Disclosed is an electrode for use in electrochemical processes especially electrowinning processes wherein a metal substrate made of a valve metal such as titanium carries a semiconducting intermediate coating consisting of a combination of tin and antimony oxides laid down upon the valve metal substrate in a series of layers and a top coating consisting of manganese dioxide applied in a series of layers.

12 Claims, No Drawings

MANGANESE DIOXIDE ELECTRODE

BACKGROUND OF THE INVENTION

This invention generally relates to electrodes for use in electrochemical processes especially electrowinning processes, having a valve metal substrate carrying a semiconducting intermediate coating consisting of tin and antimony oxides with a top coating consisting of manganese dioxide to provide an electrode at considerably less cost while obtaining low cell voltages for given current densities. More particularly the present disclosure relates to a much improved electrode having a valve metal substrate, such as titanium, carrying a semiconducting intermediate coating consisting of tin and antimony compounds applied in a series of layers and baked to their respective oxides; and a top coating consisting of manganese compounds applied in a series of several layers and baked into its dioxide form.

Electrochemical methods of manufacture are becoming ever increasingly important to the chemical industry due to their greater ecological acceptability, potential for energy conservation, and the resultant cost reductions possible. Therefore, a great deal of research and development efforts have been applied to electrochemical processes and the hardware for these processes. One major element of the hardware aspect is the electrode itself. The object has been to provide: an electrode which will withstand the corrosive environment within an electrolytic cell; an efficient means for electrochemical production; and an electrode cost within the range of commercial feasibility. Only a few materials may effectively constitute an electode especially to be used as an anode because of the susceptability of most other substances to the intense corrosive conditions. Among these materials are: graphite, nickel, lead, lead alloy, platinum, or platinized titanium. Electrodes of this type have limited applications because of the various disadvantages such as: a lack of dimensional stability; high cost; chemical activity; contamination of the electrolyte; contamination of a cathode deposit; sensitivity to impurities; or high oxygen overvoltages. Overvoltage refers to the excess electrical potential over theoretical potential at which the desired element is discharged at the electrode surface.

The history of electrodes is replete with examples of attempts and proposals to overcome some of the problems associated with the electrode in an electrolytic cell, none of which seems to have accomplished an optimization of the desirable characteristics for an electrode to be used in an electrolytic cell. Currently, in an electrowinning process for example the cell is operated at a relatively low current density of less than 1 ampere per square inch (155 milliamperes per square centimeter). The problem in this case is to find an electrode which will have many of the desirable characteristics listed above and additionally have a low half cell voltage at given current densities so as to conserve a considerable amount of energy in the electrochemical process. It is known for instance that platinum is an excellent material for use in electrode to be used as an anode in an electrowinning process and satisfies many of the above-mentioned characteristics. However, platinum is expensive and hence has not been found suitable for industrial use to date. Carbon and lead alloy electrodes have been generally used, but the carbon anode has the disadvantage that it greatly pollutes the electrolyte due to the fast wearing and has an increasingly higher electrical resistance which results in the increase of the half cell potential. This higher half cell potential causes the electrolytic cell to consume more electrical power than is desirable. The disadvantages of the lead alloy anode are that the lead dissolves in the electrolyte and the resulting solute is deposited on the cathode subsequently resulting in a decrease in the purity of the deposit obtained, and that the oxygen overvoltage becomes too high. Another disadvantage of the lead alloy anode is that the $PbO_2$ changes to a $Pb_3O_4$ which is a poor conductor. Oxygen may penetrate below this layer and flake off the film resulting in particles becoming trapped in the deposited copper on a cathode. This causes a degrading of the copper plating which is very undesirable.

It has been proposed that platinum or other precious metals be applied to a titanium substrate to retain their attractive electrical characteristics and further reduce the manufacturing costs. However, even this limited use of precious metals such as platinum which can cost in the range of about $30.00 per square foot ($323.00 per square meter) of electrode surface areas are expensive and therefore not desirable for industrial uses. It has also been proposed that the surfaces of titanium be plated electrically with platinum to which another electrical deposit either of lead dioxide or manganese dioxide be applied. The electrodes with the lead dioxide coating have the disadvantage of comparatively high oxygen overvoltages and both types of coatings have high internal stresses when electrolytically deposited which are liable to be detached from the surface during commercial usage, contaminating the electrolyte and the product being deposited on the cathode surface. Thus, the current density of such anodes is limited and handling of such anodes must be done with extreme care. Another attempted improvement has been to put a layer of manganese dioxide on the surface of a titanium substrate which is relatively porous in nature and building up a number of layers of the manganese dioxide to so as to present an integral coating. This yields relatively low half cell potentials as long as the current density remains below 0.5 ampere per square inch (77.5 milliamperes per square centimeter) but as the current density is increased to near 1 ampere per square inch (155 milliamperes per square centimeter) the half cell potential required rises rather rapidly on this type of electrode, resulting in a considerable disadvantage at higher current densities. Therefore, to date, none of these proposals have met with much commercial success basically because efficiencies and cost reductions desired have not been achieved to this point.

SUMMARY OF THE INVENTION

It is therefore an object of the present invention to provide an electrode having the desired operational characteristics which can be manufactured at a cost within the range of commercial feasibility.

Another object of the present invention is to provide an improved electrode for use in an electrolytic cell which will have longer wear characteristics within the given cell environment.

These and other objects of the present invention, together with the advantages thereof over existing and prior art forms which will become apparent to those skilled in the art from the detailed disclosure of the present invention as set forth hereinbelow, are accomplished by the improvements herein described and claimed.

It has been found that an improved electrode for use in an electrolytic cell can be made of a valve metal substrate selected from the group of aluminum, molybdenum, niobium, tantalum, titanium, tungsten, zirconium, and alloys thereof; on the surface of the base substrate a semi-conductive intermediate coating of tin and antimony compounds applied and converted to their respective oxides; and on the surface of the semi-conductive intermediate coating a top coating of manganese dioxide.

DESCRIPTION OF THE PREFERRED EMBODIMENT

The improved electrode which will overcome many of these disadvantages of the prior art consists of a valve metal substrate which carries a semi-conductive intermediate coating of tin and antimony oxides and a top coating of manganese dioxide. The valve metal substrate which forms the base component of the electrode is an electro-conductive metal having sufficient mechanical strength to serve as a support for the coatings and should have high resistance to corrosion when exposed to the interior environment of an electrolytic cell. Typical valve metals include: aluminum, molybdenum, niobium, tantalum, titanium, tungsten, zirconium and alloys thereof. A preferred valve metal based on cost, availability and electrical and chemical properties is titanium. There are a number of forms the titanium substrate may take in the manufacture of an electrode, including for example: solid sheet material, expanded metal mesh material with a large percentage of open area, and a porous titanium with a density of 30 to 70 percent pure titanium which can be produced by cold compacting titanium powder. Porous titanium is preferred in the present invention for its long life characteristics along with its relative structural integrity. If desired the porous titanium can be reinforced with titanium mesh in the case of a large electrode.

The semi-conductive intermediate coating of tin and antimony oxides is a tin dioxide coating that has been modified by adding portions of a suitable inorganic material, commonly referred to as a "dopent". The dopent of the present invention is an antimony compound such as $SbCl_3$ which forms an oxide when baked in an oxidizing atmosphere. Although the exact form of the antimony in the coating is not certain, it is assumed to be present as a $Sb_2O_3$ for purposes of weight calculations. The compositions are mixtures of tin dioxide and a minor amount of antimony trioxide, the latter being present in an amount of between 0.1 and 30 weight percent, calculated on the basis of total weight percent of $SnO_2$ and $Sb_2O_3$. The preferred amount of the antimony trioxide in the present invention is between 3 and 15 weight percent.

There are a number of methods for applying the semiconductive intermediate coating of tin and antimony oxides on the surface of the valve metal substrate. Typically such coatings may be formed by first physically and/or chemically cleaning the substrate, such as by degreasing and etching the surface in a suitable acid (such as oxalic or hydrochloric acid) or by sandblasting; then applying a solution of appropriate thermally decomposable compounds; drying; and heating in an oxidizing atmosphere. The compounds that may be employed include any thermally decomposable inorganic or organic salt or ester of tin and the antimony dopent, including their alkoxides, alkoxy halides, amines, and chlorides. Typical salts include: antimony pentachloride, antimony trichloride, dibutyl tin dichloride, stannic chloride and tin tetraethoxide. Suitable solvents include: amyl alcohol, benzene, butyl alcohol, ethyl alcohol, pentyl alcohol, propyl alcohol, toluene and other organic solvents as well as some inorganic solvents such as water.

The solution of thermally decomposable compounds, containing salts of tin and antimony in the desired proportion, may be applied to the cleaned surface of the valve metal substrate by brushing, dipping, rólling, spraying, or other suitable mechanical or chemical methods. The coating is then dried by heating at about 100° centigrade to 200° centigrade to evaporate the solvent. This coating is then baked at a higher temperature such as 250° centigrade to 800° centigrade in an oxidizing atmosphere to convert the tin and antimony compounds to their respective oxides. This procedure is repeated as many times as necessary to achieve a desired coating thickness or weight appropriate for the particular electrode to be manufactured. When porous titanium substrate is used, a desirable semi-conductive intermediate coating can be accomplished by sucking a solution of tin and antimony compounds through the substrate 2 to 6 times with baking between, and for titanium plate the desired thickness can be obtained by applying 2 to 6 coats of the tin and antimony compounds. Alternatively, a desired thickness of the semi-conductive intermediate coating can be built up by applying a number of layers with drying between applications such that the baking process to convert the tin and antimony compounds to their respective oxides is performed only once at the end of a series of layering steps. This method reduces the loss of tin and antimony due to vaporization of the compounds during the baking step and used mainly with stannic chloride.

The top coating of the electrode, of manganese dioxide, can be applied by several methods such as dipping, electroplating, spraying or other suitable methods. The top coating can be layered in the same fashion as the intermediate coating to build up a thickness or weight per unit area as desired for the particular electrode. In the case of titanium mesh, one method for applying the manganese dioxide prior to drying is to electroplate manganese dioxide directly onto the coated electrode. Because of the rather large open areas in a mesh used for these foraminous electrodes, the electroplating is a more effective method of applying the manganese dioxide to assure a complete and even coverage of the entire surface of the electrode. If titanium plate or porous titanium is used, the thermally decomposable manganese compounds may be painted or sprayed on the electrode in a series of layers with a drying period between each layer and a brushing off of any excess material present on the surface after drying. After the strip is allowed to dry at room temperature it can then be baked for short periods of time at an elevated temperature to transform the manganese compounds into manganese dioxide.

A major use of this type of electrode is expected to be in the electrodeposition of metals from aqueous solutions of metals salts, such as electrowinning of antimony, cadmium, chromium, cobalt, copper, gallium, indium, manganese, nickel, thallium, tin or zinc. Other possible uses include: cathodic protection of marine equipment, electrochemical generation of electrical power, electrolysis of water and other aqueous solutions, electrolytic cleaning, electrolytic production of metal powders, electro organic synthesis, and electroplating. Additional specific uses might be for the production of chlorine or hypochlorite.

In order that those skilled in the art may more readily understand the present invention and certain preferred aspects by which it may be carried into effect, the following specific examples are afforded.

EXAMPLE 1

A solution for the semi-conductive intermediate coating was prepared by mixing 30 milliliters of butyl alcohol, 5 milliliters of hydrochloric acid (HCl), 3.2 grams of antimony trichloride ($SbCl_3$), and 15.1 grams of stannic chloride pentahydrage ($SnCl_4 \cdot 5H_2O$). A strip of clean titanium plate was immersed in hot HCl for ½ hour to etch the surface. It was then washed with water and dried. The titanium was then coated twice by brushing with the alkoxy tin-antimony trichloride solution described above. The surface of the plate was dried for 10 minutes in an oven at 125° C. after applying each coating. The titanium was then baked at 480° C. for 7 ± 1 minutes. The theoretical composition of the coating thus prepared was 81.7 percent $SnO_2$ and 18.3 percent antimony oxides (calculated as $Sb_2O_3$). The strip of titanium plate was then electroplated for 10 minutes at 0.025 ampere per square inch (4 milliamperes per square centimeter) and at 80° ± 85° C. in a bath containing a mixture consisting of 150 grams of manganese sulfate and 25 grams of concentrated $H_2SO_4$ per liter. The strip was allowed to dry in air at room temperature. The strip was painted with a mixture consisting of equal volumes of isopropyl alcohol and a 50 percent aqueous solution of manganese nitrate, and baked for 10 minutes in an oven at 205° C. This electroplating, painting, and baking cycle was repeated two more times. An additional layer was electroplated as described above, also including air drying at room temperature and a final bake at 205° C. for 10 minutes. During each of the above cycles, when the coated strip was removed from the oven, any excess coating was removed by brushing the strip under running water.

The anode, prepared as described above, was installed and tested as an anode in a cell containing dilute sulfuric acid (150 grams of conc. $H_2SO_4$/liter) maintained at a temperature of about 50° C. The test was conducted at constant current densities of 1, 3 and 5 amperes per square inch (155, 465 and 775 milliamperes per square centimeter); the anode exhibited potentials of 1.45, 1.52 and 1.59 volts (versus a saturated calomel electrode), respectively.

EXAMPLE 2

A strip of clean titanium plate was etched and then two double coatings of conductive tin dioxide were applied by repeating the entire brush-dry-bake cycle described in Example 1. The baking temperature was 490° C. instead of 480° C. specified in Example 1. The strip of titanium was electroplated for eight minutes at 0.025 ampere per square inch (39 milliamperes per square centimeter) and at 80° to 85° C. in a bath containing manganese sulfate (150 grams per liter) and concentrated sulfuric acid (25 grams per liter). The strip was then allowed to air dry at room temperature and was then baked for 10 minutes in an oven maintained at 205° C. This was repeated three times.

The anode, prepared as described above, was installed and tested as an anode in a cell containing dilute sulfuric acid (150 grams per liter) at a temperature of about 50° C. The test was conducted at current densities of 1, 3 and 5 amperes per square inch (155, 465 and 775 milliamperes per square centimeter); the anode exhibited potentials of 1.44, 1.50 and 1.55 volts, respectively. The weight of the $MnO_2$ coating was 0.075 gram, equivalent to about 29 grams per square meter.

EXAMPLE 3

A strip of clean titanium plate, etched, coated with tin dioxide and plated with manganese dioxide as described in Example 2, was baked an additional 66 hours at 205° C.

The anode, prepared as described above, was installed and tested as an anode in a cell containing dilute sulfuric acid (150 grams per liter) maintained at a temperature of about 50° C. The test was conducted at current densities of 1, 3 and 5 amperes per square inch (155, 465 and 775 milliamperes per square centimeter); the anode exhibited potentials of 1.43, 1.48 and 1.51 volts, respectively.

EXAMPLE 4

A strip of clean titanium plate, etched and coated with tin dioxide as described in Example 2, was electroplated for 24 minutes at 0.025 ampere per square inch (4 milliamperes per square centimeter) and at 80° to 85° C. in a bath containing manganese sulfate (150 grams per liter) and concentrated sulfuric acid (25 grams per liter). The weight of the $MnO_2$ coating was 0.083 gram, equivalent to about 34 grams per square meter. This plate was not baked after electroplating in the manganese sulfate-sulfuric acid bath.

The anode, prepared as described above, was tested as an anode as described in Examples 2 and 3. Passivation occurred and no readings of potential could be made. This test shows that a titanium plate containing a $MnO_2$ coating over tin dioxide requires baking, as described in Examples 2 and 3, so that it may exhibit a useful life.

EXAMPLE 5

A strip of clean titanium plate was etched and coated with three double coatings of tin dioxide using the method described in Example 1 except that the baking temperature after applying each double coating was 560° C. instead of 490° C. as specified in Example 1.

The strip of titanium plate was then electroplated for 20 minutes at 0.0166 ampere per square inch (1.8 milliamperes per square centimeter) and at 90° to 95° C. in a bath containing manganese sulfate (150 grams per liter) and concentrated sulfuric acid (25 grams per liter). The strip was then allowed to dry in air at room temperature and was then painted with a mixture consisting of equal volumes of isopropyl alcohol and of a 50 percent aqueous solution of manganese nitrate and then baked for ten minutes in an oven at a temperature of 205° C. This electroplating-painting-baking cycle was repeated two more times. Additional coatings of $MnO_2$ were applied to the plate using three electroplating-painting-baking cycles under the conditions specified in the previous paragraph with the exception that the electroplating period was increased to 30 minutes during each cycle. The weight of the $MnO_2$ coatings applied thus far was 0.524 gram, equivalent to about 135 grams per square meter. Additional coatings of $MnO_2$ were applied to the plate using five electroplating-painting-baking cycles under the conditions of the preceding paragraph with the exception that the current was increased to 0.15 ampere per square inch (23 milliamperes per square centimeter). The total electroplating time for all the cycles specified in this Example was five hours.

The titanium strip, prepared as described above, was tested as an anode in a cell containing 150 grams per liter of concentrated sulfuric acid maintained at a temperature of about 50° C. The anode exhibited potentials of 1.48, 1.56 and 1.62 volts at current densities of 1, 3 and 5 amperes per square inch (155, 465 and 775 milliamperes per square centimeter), respectively.

EXAMPLE 6

A strip of porous titanium was etched and coated with two double coatings of tin dioxide using the method described in Example 1 except that the strip was baked at 500° C. for 20 minutes instead of 490° C. for seven minutes. The coated titanium strip was then dipped into a mixture consisting of 20 milliliters water, 5 milliliters isopropyl alcohol and 5 ml. manganese nitrate (50 percent aqueous solution). The strip was allowed to dry in air at room temperature and was then baked for 30 minutes in an oven maintained at 205° C. This dipping-baking process was repeated four times. The weight of the $MnO_2$ coating was about 50 grams per square foot (540 grams per square meter).

The titanium strip, prepared as described above, was tested as an anode, as described in Example 1. The area of the anode was 2.4 square inches (15.48 square centimeters) including the front, back and edges. The anode exhibited potentials of 1.41, 1.52 and 1.59 volts at current densities of 0.25, 1.0 and 3.0 amperes per square inch (39, 155 and 465 milliamperes per square centimeter), respectively.

EXAMPLE 7

A strip of porous titanium was etched and coated with two double coatings of tin dioxide as described in Example 6. Coatings of $MnO_2$ were then applied by electroplating and dipping. The strip was electroplated at room temperature for 20 minutes using a current of 0.03 ampere per square inch (4.7 milliamperes per square centimeter) in a bath containing manganese sulfate (150 grams per liter) and concentrated sulfuric acid (25 grams per liter). The strip was allowed to dry in air at room temperature. It was then dipped into a mixture consisting of 20 milliliters water, 5 milliliters isopropyl alcohol and 5 milliliters manganese nitrate (50 percent aqueous solution) and then baked in an oven at 205° C. for 30 minutes. This plating-dipping-baking cycle was repeated three more times to increase the thickness of the $MnO_2$ coating.

The titanium strip, prepared as described above, was tested as an anode as described in Examples 1 and 6. The anode exhibited potentials of 1.41, 1.47 and 1.54 volts at current densities of 0.25, 1.0 and 3.0 amperes per square inch (39, 155 and 465 milliamperes per square centimeter), respectively.

EXAMPLE 8

A strip of porous titanium was etched and coated with $MnO_2$ as described in Example 6 except that no coating of tin dioxide was applied. The weight of the $MnO_2$ coating was about 55 grams per square foot (600 grams per square meter).

The titanium strip, prepared as described above, was tested as an anode as described in Example 6. The anode exhibited potentials of 1.62, 1.95 and 2.27 volts at current densities of 0.25, 1.0 and 3.0 amperes per square inch (39, 155 and 465 milliamperes per square centimeter), respectively.

By comparing these results with the test results of the anode containing an intermediate conductive tin dioxide layer (see Example 6), it is apparent that the anode with the conductive tin dioxide layer has lower potentials (0.21, 0.43, and 0.68 volts) when tested at 0.25, 1.0, 3.0 amperes per square inch (39, 155 and 465 milliamperes per square centimeter), respectively.

EXAMPLE 9

A strip of porous titanium was etched and coated with conductive tin dioxide using the method described in Example 1 except that vacuum was used to pull the alkoxy tin-antimony trichloride solution through the strip each time that it was applied thereby producing a more uniform coating. The following conditions in preparing this electrode were also different from those specified in Example 1: drying time at 125° C was 20 minutes, baking time was 30 minutes, baking temperature was 500° C, and two more tin dioxide conductive coatings were applied by repeating the coat-dry-bake cycle described above.

The strip of titanium plate was coated with 50 percent aqueous manganese nitrate solution; vacuum was then applied to pull the solution through the pores. The coating-vacuum cycle was repeated one time, then the strip was baked at 200° C for 30 minutes. The above procedure for preparing the $MnO_2$ coating was repeated five times to increase the thickness of the $MnO_2$ layer.

The anode, prepared as described above, was installed and tested as an anode in a cell containing 150 grams of concentrated sulfuric acid per liter of solution. The cell temperature was maintained at 50° C throughout the test. The anode exhibited potentials of 1.41, 1.45 and 1.52 volts at current densities of 0.4, 1.0 and 3.0 amperes per square inch (62, 155 and 465 milliamperes per square centimeter), respectively.

EXAMPLE 10

An anode was prepared as described in Example 9 except that no conductive tin dioxide coating was applied; the procedure used in Example 9 to apply that coating was, therefore, omitted. However, the $MnO_2$ coating was applied in the normal manner, as described in Example 9.

The anode, prepared as described above, was tested as described in Example 9. The anode exhibited potentials of 1.43, 1.54 and 1.78 volts at current densities of 0.4, 1.0 and 3.0 amperes per square inch (62, 155 and 465 milliamperes per square centimeter), respectively. By comparing the test results of the anodes prepared in Examples 9 and 10, it is apparent that the anode containing the conductive tin dioxide coating exhibited lower voltages, i.e., 0.02, 0.09, 0.26 volts at 0.4, 1.0 and 3.0 amperes per square inch (62, 155 and 465 milliamperes per square centimeter), respectively. This lowering of voltage is particularly striking at high current densities which are economically desirable in an industrial process.

EXAMPLE 11

A strip of clean titanium plate was etched and then the semi-conductive intermediate tin coating of oxides was applied as described in Example 1 except that the baking temperature was 600° C. The coated titanium strip was then painted with a 50 percent aqueous solution of manganese nitrate and fired at approximately 300° C. This process was repeated until approximately 14.4 grams per square foot (155 grams per square meter) of manganese dioxide were present on the strip.

The titanium strip, prepared as described above, was tested as an anode, as described in Example 1. The area of the anode was approximately 12 square inches (77.4 square centimeters) and exhibited potentials of 1.38, 1.42, and 1.43 volts at current densities of 1.0, 3.0 and 5.0 amperes per squre inch (155, 465 and 775 milliamperes per square centimeter), respectively.

EXAMPLE 12

Three strips of clean titanium plate were etched and then the semi-conductive intermediate coating of tin and antimony oxides were applied according to Example 1 until each of the three strips had between 0.012 grams and 0.014 grams weight gain of tin and antimony compounds. The area of each strip was approximately 4 square inches (25.8 square centimeters). Strip A was then electroplated with manganese dioxide for three hours to obtain a weight gain of approximately 18.9 grams per square foot (203 grams per square meter) of manganese dioxide. Strip B was electroplated in one-half hour intervals and baked for 20 minutes at approximately 220° C between each half hour of electroplating, a total of five times to obtain approximately 14.5 grams per square foot (155 grams per square meter) of manganese dioxide on the surface of strip B. Strip C was first electroplated for one-half hour and then coated with a thermally decomposable manganese nitrate and baked for twenty minutes at approximately 220° C. This process was repeated five times to obtain a weight gain of approximately 15.8 grams per square foot (170 grams per square meter) of manganese dioxide onto the surface of strip C.

The resultant strips A, B and C prepared as described above were tested as anodes in a cell containing 150 grams per liter of concentrated sulfuric acid maintained at a temperature of approximately 50° C. Strip A when subjected to a current density of approximately 0.5 amperes per square inch (77.5 milliamperes per square centimeter) developed a serious flaking off of the coatings. Strip B exhibited a potential of 1.41, 1.45 and 1.57 volts at current densities of 0.5, 1.0 and 3.0 amperes per square inch (77.5, 155 and 465 milliamperes per square centimeter), respectively. There was a flaking off of the coating at the bottom edge of strip B during this process. Strip C exhibited potentials of 1.41, 1.43 and 1.50 volts at current densities of 0.5, 1.0 and 3.0 amperes per square inch (77.5, 155 and 465 milliamperes per square centimeter), respectively.

EXAMPLE 13

A strip of porous titanium having a surface area of approximately 7 square inches (45 square centimeters) was coated with a solution of tin and antimony compounds by use of a vacuum to suck the solution through the porous material. The solution consisted of 5.27 grams of stannous sulfate, 2.63 grams of antimony trichloride, 10 milliliters of hydrochloric acid, and 20 milliliters of butyl alcohol. This was done four times with the baking of one-half hour at approximately 500° C between each pass through the porous titanium material. A 50 percent aqueous solution of manganese nitrate was passed through the material in the same fashion with a baking between each pass of 45 to 60 minutes at approximately 200 degrees centigrade until a weight gain in the range of 3.36 to 3.56 grams of manganese dioxide is contained therein.

The strip of porous titanium prepared as described above was tested as an anode, as described in Example 1. The anode exhibited potentials of 1.44, 1.49, 1.51, 1.54 volts at current densities of 0.25, 0.5, 0.75, and 1.0 (39, 77.5, 116 and 155 milliamperes per square centimeter), respectively. Life tests of this anode have revealed that the anode is in good working order after over 2,000 hours of continuous use.

EXAMPLE 14

A strip of porous titanium was coated with tin/antimony compounds by sucking through the material with a vacuum, a solution of tin and antimony compounds as described in Example 13. This procedure was repeated four times with baking between each pass of one hour at approximately 490° C. A solution of 50 percent aqueous manganese nitrate was also sucked through the coated porous titanium strip with a vacuum four times with a 40 to 50 minute baking at 210° C after each application.

The porous titanium strip prepared as above-described was tested as an anode as described in Example 1. The anode exhibited a potential of 1.49 volts at a current density of 0.5 amperes per square inch (77.5 milliamperes per square centimeter). This electrode remains in good condition after over 2,000 hours of continuous use thus showing a good lifetime.

Thus it should be apparent from the foregoing description of the preferred embodiment that the composition hereindescribed accomplishes the objects of the invention and solves the problems that attendant to such electrode compositions for use in electrolytic cells for electrochemical production.

What is claimed is:

1. An electrode for use in an electrolytic process comprising: a valve metal substrate selected from the group of aluminum, molybdenum, niobium, tantalum, titanium, tungsten, zirconium and alloys thereof; on the surface of said valve metal substrate, a semi-conductive intermediate coating consisting essentially of tin and antimony compounds applied and converted to their respective oxides such that said semi-conductive intermediate coating attains a weight greater than 2 grams per square meter of said valve metal substrate surface area; and on the surface of said semi-conductive intermediate coating, a top coating consisting essentially of manganese dioxide such that said top coating attains a weight greater than 25 grams per square meter of said valve metal substrate surface area.

2. An electrode according to claim 1 wherein said valve metal substrate is titanium.

3. An electrode according to claim 2 wherein said valve metal substrate is porous titanium.

4. An electrode according to claim 1 wherein said semi-conductive intermediate coating of tin and antimony compounds has between 0.1 and 30 weight percent of antimony compounds.

5. An electrode according to claim 4 wherein said semi-conductive intermediate coating of tin and antimony compounds has an amount of antimony compounds within the preferred range of 3 to 15 weight percent.

6. A method for the manufacture of an electrode for use in an electrolytic process comprising the steps of: selecting a valve metal substrate from the group of aluminum, molybdenum, niobium, tantalum, titanium, tungsten, zirconium or alloys thereof; applying to the valve metal substrate two to six coats of, a semi-conductive intermediate coating consisting essentially of thermally decomposable compounds of tin and antimony containing 0.1 to 30 weight percent antimony to attain a weight greater than 2 grams per square meter of the valve metal substrate surface area; drying the semi-conductive intermediate coating at a temperature in the range of 100° to 200° centigrade; baking the semi-conductive intermediate coating in an oxidizing atmosphere at an elevated temperature in the range of 250° to 800° C to transform the tin and antimony compounds to their respective oxides; and applying on the surface of the semi-conductive intermediate coating, a top coating consisting essentially of manganese dioxide weighing more than 25 grams per square meter of the valve metal substrate surface area.

7. A method according to claim 6 wherein each coat of the semi-conductive intermediate coating is dried before subsequent application of the next layer, and being baked at the conclusion thereof to their respective oxides.

8. A method according to claim 6 wherein said outer coating is applied by painting manganese nitrate in a series of layers, dried, and baked to its dioxide form.

9. A method according to claim 6 wherein said outer coating of manganese dioxide is applied by electroplating manganese dioxide upon the surface of said semi-conductive intermediate coating.

10. A method according to claim 6 wherein said outer coating is applied by electroplating in a bath containing manganese sulfate; drying the layer at room temperature; painting a solution containing manganese nitrate over said electroplated layer; baking said outer coating to transform the manganese into its dioxide form; and repeating this process two to six times.

11. A method according to claim 6 wherein porous titanium is selected, and the method for applying the semiconductive intermediate coating is by sucking a solution through the substrate using a vacuum.

12. A method according to claim 11 wherein the method for applying the top coating of manganese dioxide is by sucking a manganese nitrate solution through the substrate using a vacuum and baking said top coating to transform the manganese to its dioxide form.

* * * * *